US005992204A

United States Patent [19]

Jonkka et al.

[11] Patent Number: 5,992,204

[45] Date of Patent: Nov. 30, 1999

[54] METHOD OF INCREASING THE STRENGTH OF A BLADE, AND A BLADE

[75] Inventors: Arvo Jonkka, Pori; Antti Tohkala, Rauma, both of Finland

[73] Assignee: Sunds Defibrator Woodhandling Oy, Pori, Finland

[21] Appl. No.: 08/894,740

[22] PCT Filed: Mar. 15, 1995

[86] PCT No.: PCT/FI95/00139

§ 371 Date: Aug. 27, 1997

§ 102(e) Date: Aug. 27, 1997

[87] PCT Pub. No.: WO96/28287

PCT Pub. Date: Sep. 19, 1996

[51] Int. Cl.[6] ..... B21D 53/64; B27G 13/00

[52] U.S. Cl. ..... 72/340; 72/53; 76/104.1; 76/115; 144/176

[58] Field of Search ..... 72/340, 365.2, 72/53; 29/90.7; 451/39; 76/104.1, 115, 116; 144/176, 162.1

[56] References Cited

U.S. PATENT DOCUMENTS

| | | | |
|---|---|---|---|
| 849,329 | 4/1907 | Colthar | 72/340 |
| 3,714,850 | 2/1973 | Peters | 76/104 |
| 4,628,976 | 12/1986 | Loring | 144/241 |
| 4,669,516 | 6/1987 | Carpenter et al. | 144/176 |
| 4,674,356 | 6/1987 | Kilgore . | |
| 5,077,961 | 1/1992 | Schumacher | 72/340 |
| 5,249,485 | 10/1993 | Hayden | 76/112 |
| 5,351,595 | 10/1994 | Johnston | 83/848 |
| 5,765,452 | 6/1998 | Roux | 144/176 |

FOREIGN PATENT DOCUMENTS

| | | | |
|---|---|---|---|
| 0538720 A1 | 4/1993 | European Pat. Off. . | |
| 1143776 | 2/1963 | Germany | 72/340 |
| 1802322 | 7/1970 | Germany . | |
| 404501 | 10/1978 | Sweden . | |
| 459646 | 7/1989 | Sweden . | |
| 1348696 | 3/1974 | United Kingdom . | |
| WO/15702 | 12/1990 | WIPO . | |

OTHER PUBLICATIONS

Peening Reference Manual, Jan. 1991 (1 page).

Kungl. Tekniska Högskolan Stockholm, 1993, pp. 15 to 17.

Kuulapommituksella lisää lujuutta Konepajamies, Nov. 1992, VTT, pp. 54 to 57.

*Primary Examiner*—Daniel C. Crane

*Attorney, Agent, or Firm*—Burns, Doane, Swecker & Mathis, L.L.P.

[57] ABSTRACT

A method of increasing the durability of the cutting point (8) of a blade, and a blade. A compression stress ($P_{10}$) is formed in at least one surface (10 or 6) joining the point (8) of the blade (1) by cold working the blade.

12 Claims, 8 Drawing Sheets

METHOD OF INCREASING THE STRENGTH OF A BLADE, AND A BLADE

This application is a 371 of PCT/FI95/00139, filed Mar. 15, 1995.

This invention relates to a method of increasing the strength of the cutting point part of a blade. The invention also relates to a cutting blade.

The invention is primarily applicable to a sharp blade used for chipping wood and usually made of steel for cutting wood or other material so that the cutting force is applied to the point of the blade and forms a force wearing and breaking the point. For example, patent specification FI 79799 describes a disc chipper provided with blades and used for chipping wood.

A problem with present blades is that blade durability requires a relatively big sharpening angle, and with an impact-like cutting process the hardness of the blade must be limited so that the blade point will not scale.

Today the durability of the blade point very often limits the sharpening angle of the blade so that it is 34–35°, for example, in cellulose wood chipping. Blade hardnesses in a range of 56–60 HRC can hereby be used. A too sharp or too hard blade point will scale during use. The blade point is nowadays made more durable by providing it with a counter-chamfer resulting in a point angle of 38–40° along a distance of about 2 mm from the point.

Blade point wear is a main problem with hard wood as blades must be replaced when the chipper will not receive any more wood.

According to the theory of the strength of materials it is common knowledge that breakage will result when tensile stress exceeds a certain limit or repeated tensile stress peaks break the material by fatiguing, whereby an initial crack leading to breakage will occur at a considerably lower level of tension.

A publication (Andreas Uhmeier) by Kungl. Tekniska H ögskolan Stockholm 1993 deals with forces affecting the blade point in wood chipping.

Shot-peening is a known method of cold working metal. Utilization of shot-peening is taught in the Peening Reference Manual (January 1991). Shot-peening is also the subject matter of Konepajamies (November/1992), a publication of the VTT.

The method according to the invention is characterized in that by cold working the blade, compression stress is formed in at least one blade surface forming the point. The blade according to the invention is characterized in that considerable compression stress exists on at least one blade surface forming the point.

An advantageous application of the method according to the invention is based on the fact that on that side of the blade point which detaches chips, compression stress is formed when manufacturing the blade, whereby the blade point bends towards the sharpening surface so that compression stress also results on the clearance side of the blade, which stress reduces quickly as the bent area ends. In connection with the manufacturing method according to the invention a very short shape also results which corresponds to the present counter-chamfer and which strengthens the blade point and on the other side of the point a "beak"-like blade point is formed, protruding from the sharpening surface and adding to the chipper's suction.

In the method according to the invention, compression stress is formed on the surfaces starting from the blade point on the part actively working the wood. At the same time a blade point results which increases chipper suction and after-sharpening may be performed on the point.

The invention and its details are described more closely in the following referring to the appended drawings, wherein the blade is shown in cross-section.

Figure 1:
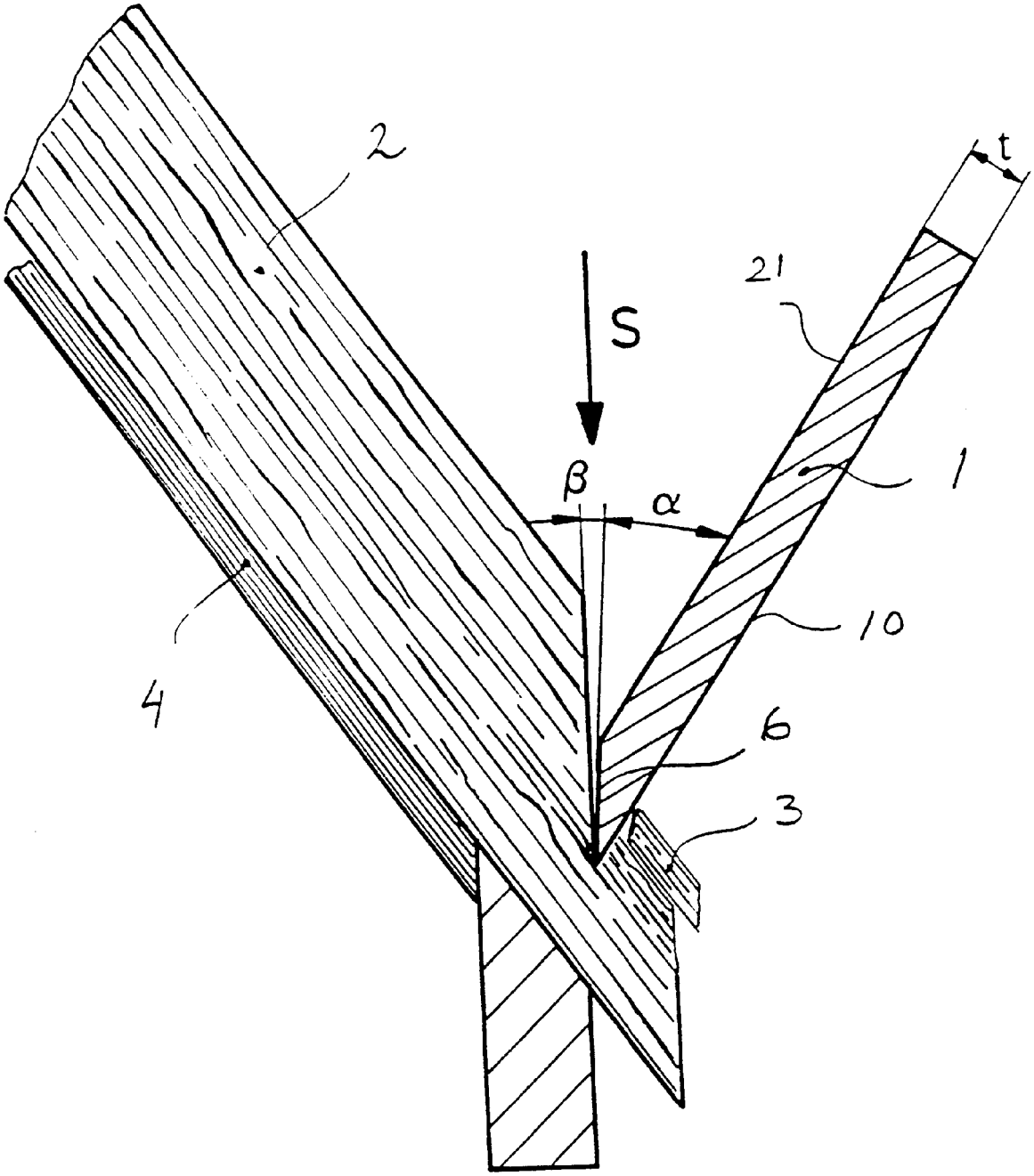
FIG. 1 shows the way in which a chipper works when used for chipping pulp wood.
Figure 13:
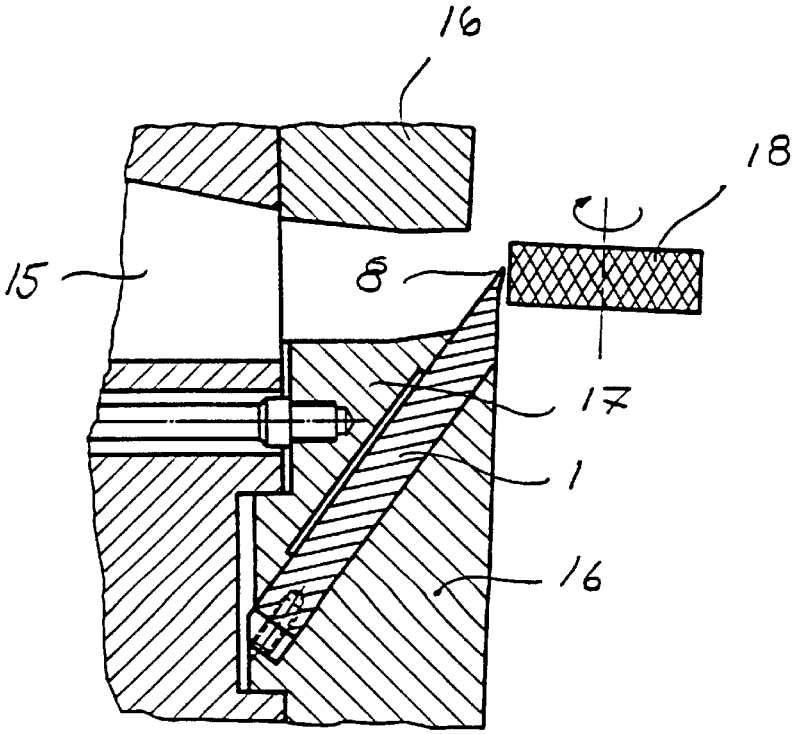

FIG. 1 shows how a blade functions when used for chipping wood. Mounting of the blade 1 on a blade disk 15 is shown in FIG. 13. Wearing plates 16 are mounted to the blade disk 15 and the blade 1 is locked in its position with a blade holder 17. Trees 2 to be chipped are guided by a chute 4 to slide against a blade disk, and blades 1 moving with the disk in direction S detach chip pieces 3. The blade 1 has a sharpening angle $\alpha$ at its cutting point, and the blade 1 is furthermore tilted so that a clearance angle $\beta$ results between the sharpening surface 6 of the blade 1 and the cut surface of the chipped wood 2, which angle usually varies so that $\beta$ is very small close to the blade disk shaft and big on the outer periphery of the blade disk. The thickness of the plate-like blade 1 is t and it is pressed in place from plate surfaces 10 and 21.

Figure 2:
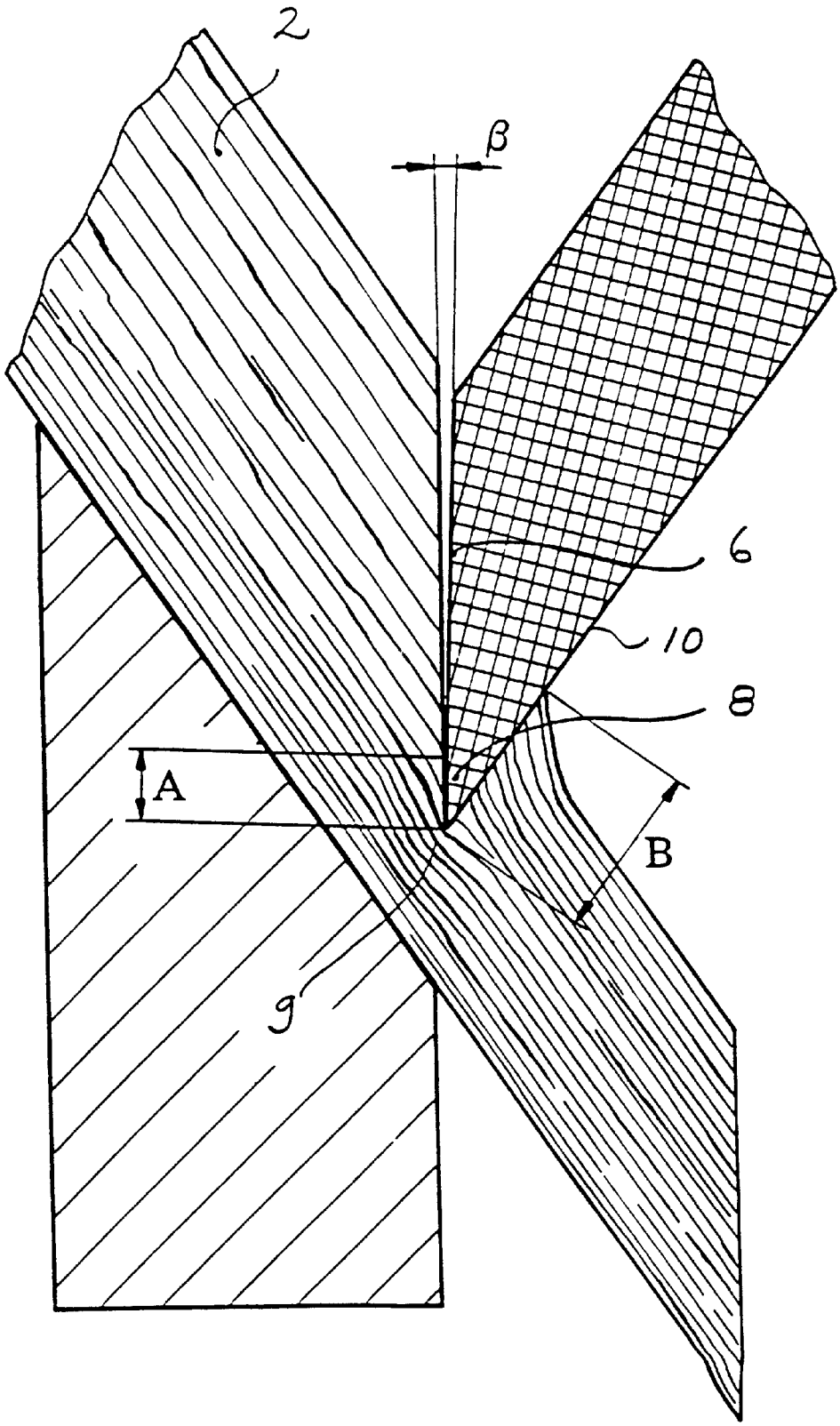
FIG. 2 shows how a blade point penetrates into the wood.

FIG. 2 shows how wood grains 9 bend under the cutting force of the blade point 8. How much grains 9 will bend depends on the properties of wood 2 and on the sharpness of the point 8. As the wood grains 9 bent into a curved shape are cut off, the elastic force of the fibres will make them press; against the sharpening surface 6 of the blade 1 as regards the. surface indicated by a measure A. The surface 10 of the blade. detaches chip pieces 3, whereby a force detaching chip pieces results at the surface part indicated by a measure B.

Figure 3:
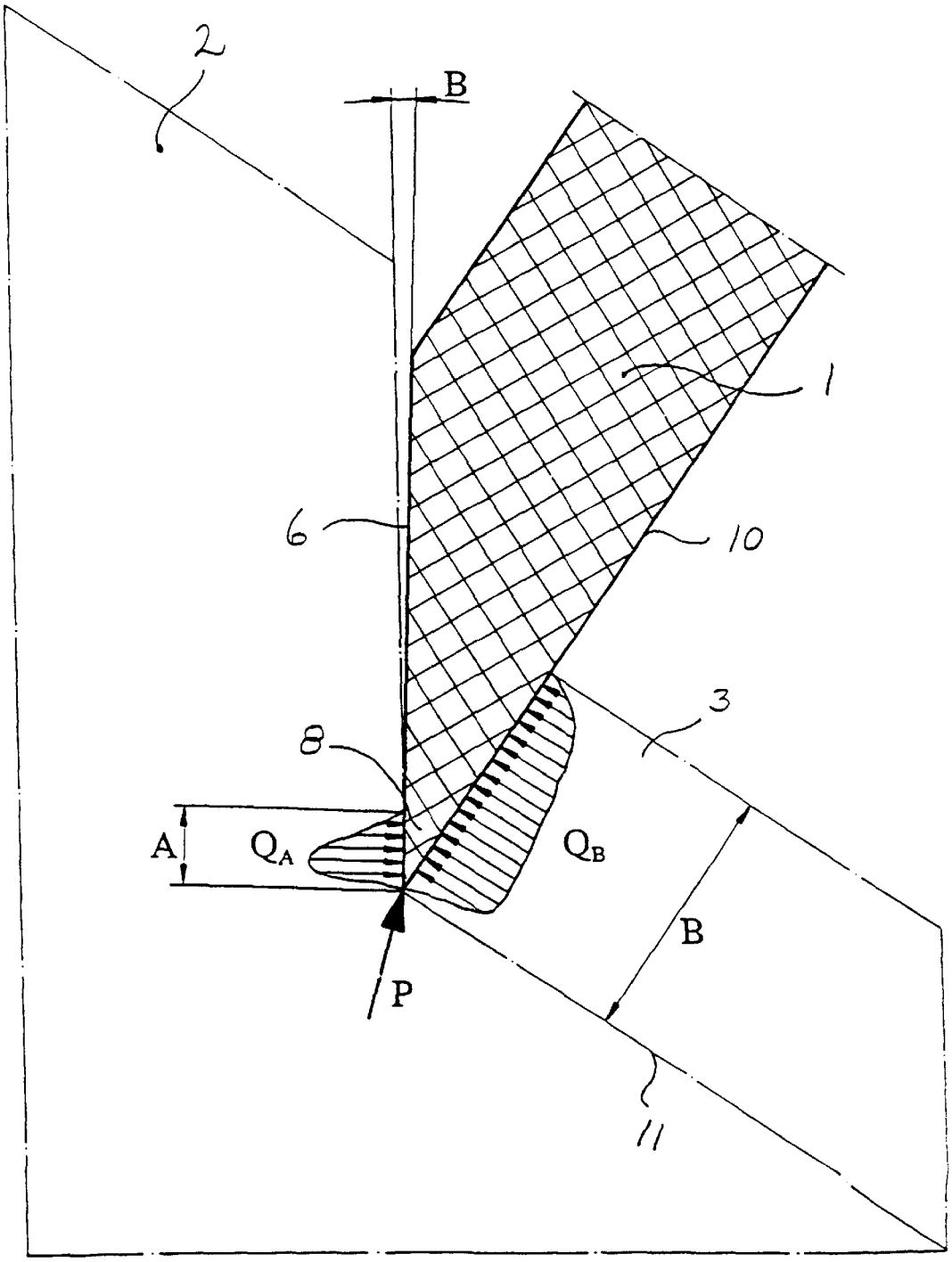
FIG. 3 shows the forces occurring in the blade point.

FIG. 3 shows force fields $Q_A$ and $Q_B$ occurring at the point 8 of the blade 1. The force field $Q_A$ occurring in the sharpening surface 6 of the blade 1 prevents the tree 2 from sliding along the feeding ramp 4, The area indicated by the measure A becomes shorter as the angle $\beta$ grows and hereby the force field $Q_A$ will also be reduced. When the blade point 8 becomes dull, the yielding of tree grains 9 increases, whereby. the measure A also grows adding to the force $Q_A$, whereby feeding of trees becomes difficult.

The width B of the force field $Q_B$ affecting the surface of the blade 1 varies very much during chipping.

After the chip piece 3 has come off along a line 11, the force field $Q_B$ is almost non-existent and the force pulling the tree 2 into the chipper or the so-called "suction power" is zero.

A case is then advantageous where wood is chipped simultaneously by two blades. This is often the case with a big tree or when chipping takes place close to the blade disk shaft.

At times during chipping, only a force $Q_A$ according to FIG. 3 is applied to the point 8 of the blade 1, whereby considerable tensile stress occurs in the surface 6 and there is a great risk of breakage in the point 8 of the blade 1. However, the area of influence of the force $Q_A$ is quite narrow, and the measure A is 1–3 mm depending on the wood 2, on the sharpness of the point 8 of the blade 1 and on the suction angle $\beta$. In addition, the blade point 8 is subject to a force P which cuts off fibres 9 and gives a compression stress to the point of the blade 1 which plays no decisive part as regards the blade's durability.

The area B where the force is applied to the surface 10 of the blade 1 which detaches chips and the total force $Q_B$ vary greatly and the force applied to the surface starting from the point 8 of the blade 1 also often in respect of the surface pressure exceeds the force applied to the surface 6 starting from the point 8. This results in forces occurring in the point of the blade 1 which will bend it in both directions.

It is a general notion that the blade 1 will work better when its sharpening angle α can be reduced. The suction angle β can then be increased which reduces the force $Q_A$ opposing the feeding of trees, and in the same proportion it is also possible to reduce the suction force $Q_B$, the magnitude of which is proportional to damages to chip pieces 3.

With this invention it is hereby possible to considerably influence chip quality and chip production capacity. The smaller sharpening angle α' offers good possibilities of increasing the suction angle β without turning the blade 1 in relation to the blade disk.

With the method according to the invention, it is possible to make a durable blade 1, where the sharpening angle α of the point 8 is by 5–60° smaller than the one presently used.

Figure 4:
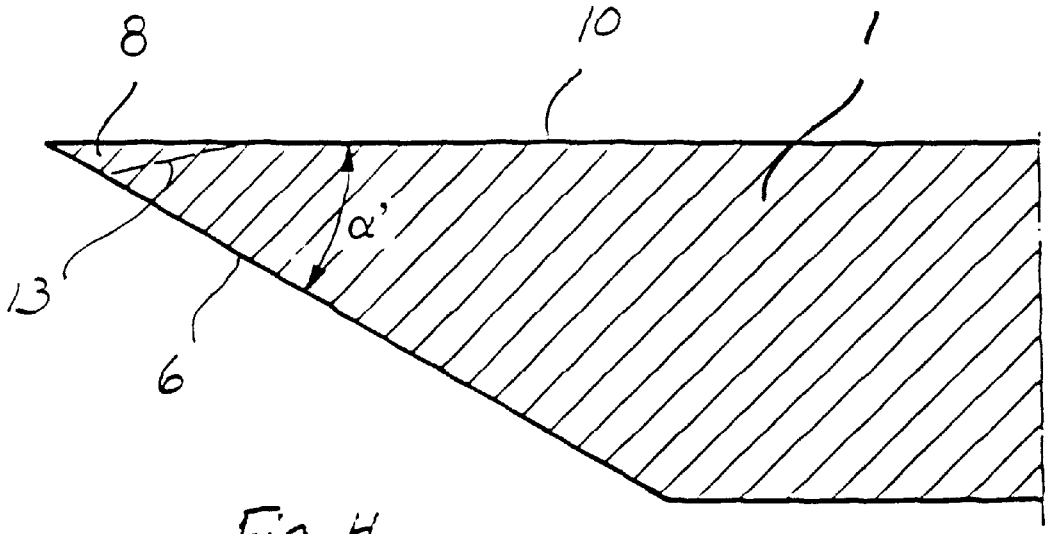
FIGS. 4 and 5 show the method of making a blade in accordance with the invention.

FIG. 4 shows a blade 1 from the point 8 of which extend a sharpening surface 6 and a chip detaching surface 10, and the sharpening angle α' between these is considerably smaller than with present blades. Presently the blade 1 is made more durable by grinding a counter-chamfer into it as indicated bey a dashed line 13.

Figure 5:
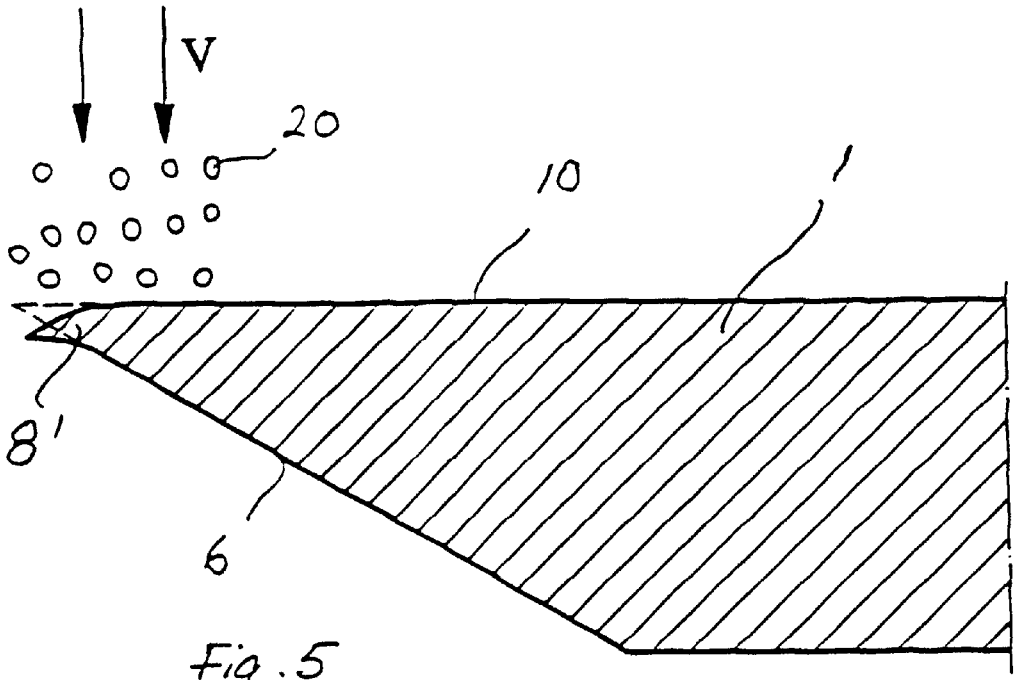

FIG. 5 shows treatment of the point of the blade 1 using a method according to the invention which is "shot-peening" and which is done after annealing and tempering of the blade 1. According to FIG. 5, the surface 10 is subjected to peening with small grains or balls 20 having a diameter of 0.1–0.6 mm and hitting the surface at a speed of 50–150 m/sec in the way indicated by arrows V. Researches show that a compression film is hereby achieved in the steel sheet surface.

The thickness of the compression stress film is 0.1–0.6 mm, and the level of compression stress is 50–60% of the yield strength of the material.

After shot-peening, the point of the blade 1 has bent in accordance with FIG. 5, forming a bent point 8'. As the point 8 bends very far, the blade 1 cannot be used without after-grinding.

Figure 6:
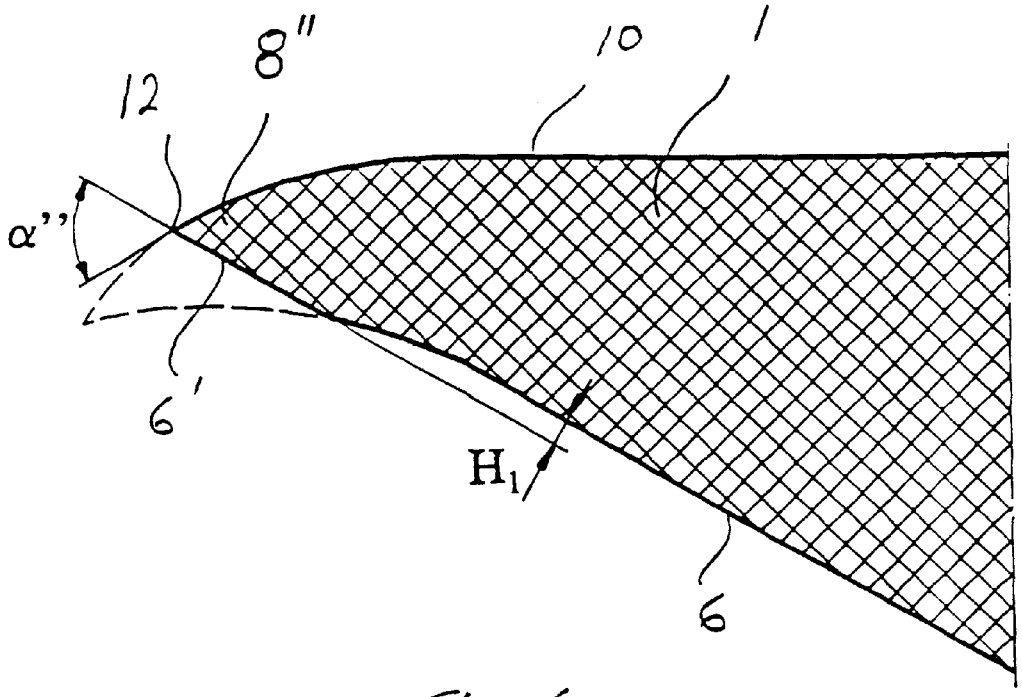
FIGS. 6, 7, 8 and 9 show states of stress in the blade point.

FIG. 6 shows an after-ground blade 1, the surface 10 of which has been shot-peened and after-ground, while the point 8" has been ground in the direction of the sharpening surface 6 so that the level of the after-ground surface 6' is higher than the level of the sharpening surface 6 by a measure $H_1$. An angle α" becomes the angle of the cutting edge 12 of the point 8" of the blade 1, and it is considerably bigger than the original sharpening angle α'.

Figure 7:
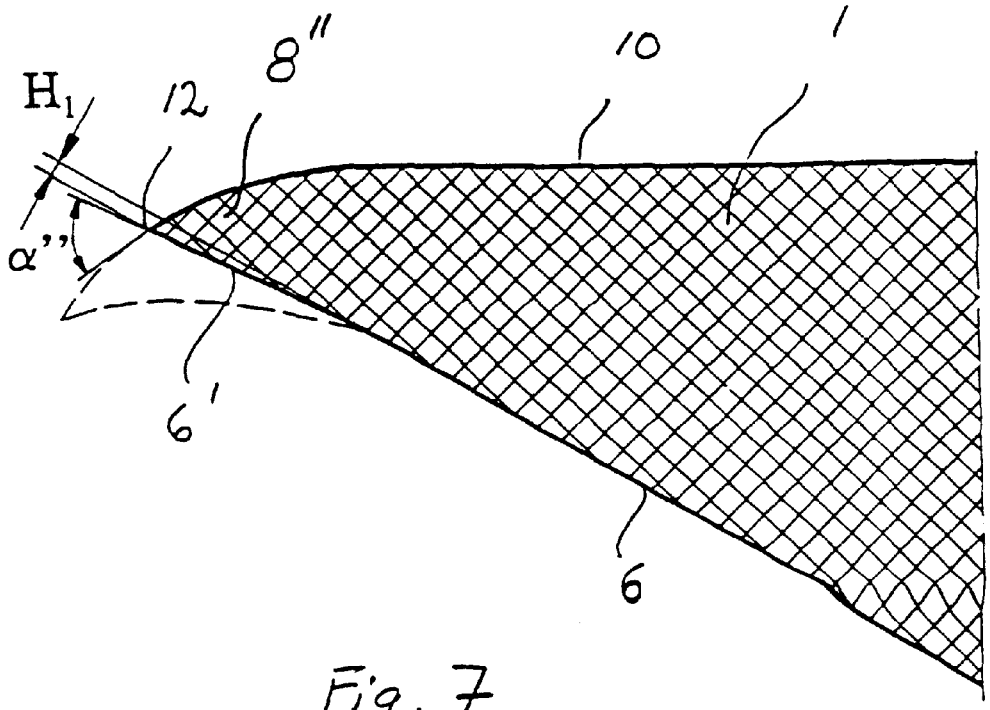

FIG. 7 shows an alternative after-grinding method whereby the after-ground surface 6' joins the surface 6 smoothly and the cutting edge 12 of the point 8 of the blade exceeds the level of the surface 6 by a measure $H_1$. Also in the blade according to FIG. 7, the angle α" of the cutting edge 12 is considerably bigger than the sharpening angle α'. With the blades shown in FIGS. 6 and 7, the angle α" of the cutting edge changes into the angle α' over a very small distance, which determines the blade properties. Using the method in accordance with the invention, it is hereby possible to make an "ideal" point 8 of the blade 1 where the angle α" of the cutting edge 12 is usually 40–45°, but may even be 60°, that is, very strong and wear-resistant, and over a distance less than 0.5 mm it turns into a very sharp sharpening angle α'. The main part of the difference between the angles α' and α" is formed by the curved shape of the surface 10 in the point 8' of the blade 1, whereby the curve is usually 10–15°, but may be 5–30° in other applications.

The length of the after-ground surface 6 is less than 0.5 mm and by means of it, it is achieved a very short distance of influence A for the force field $Q_A$ in accordance with FIGS. 2 and 3, because the point 8 of the blade 1 shown in FIGS. 6 and 7 in practice gives a great effect increasing the suction angle β which is due to the fact that the displacement of the cutting edge 12 by the measure $H_1$ changes into an "additional-suction angle" in its entirety.

From this follows that blades 1, where the cutting edge 12 has been displaced from the sharpening surface 6 upwards bey the measure $H_1$, have a smaller force $Q_A$ opposing the feeding of trees 2. The feeding of trees into the chipper is hereby improved and there is less risk of jamming of the chipper even with hard wood and with dull blades. The same result is achieved by increasing the suction angle β, but this will impair the durability of the point 8 of the blade 1 more than the very short "clearance" in the blade point given by the measure $H_1$ in accordance with FIGS. 6 and 7.

The main purpose of the invention is to increase the durability of the point 8 of the blade 1. As the blade point is;

affected by forces in both lateral directions according to the foregoing description, a thin compression stress zone must be obtained on surfaces 10 and 6 in the blade point.

Figure 8:
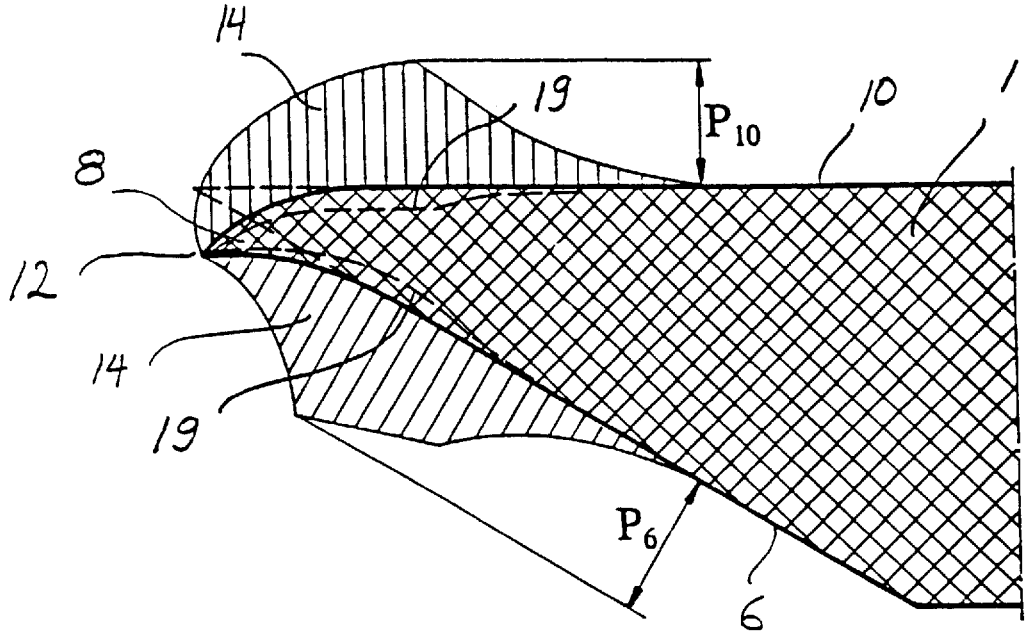

The shot-peened blade 1 whose point 8 has bent as shown in FIGS. 5 and 8 achieves in its blade surfaces 6 and 10 the compression stress level shown schematically in FIG. 8. The relative compression stress of the shot-peened surface is shown schematically by lines 14, the length of which represents the relative magnitude of the compression stress. The highest compression stress $P_{10}$ is achieved through shot-peening at full power. Due to the bending of the point 8, the compression stress decreases towards the cutting edge 12 of the blade.

Compression stress occurs in the sharpening surface ϵ because the blade point 8 bends, and partial upsetting of the material also occurs here. The compression stress peak $P_6$ in the surface 6 is higher than the compression stress $P_{10}$ in the surface 10.

Figure 9:
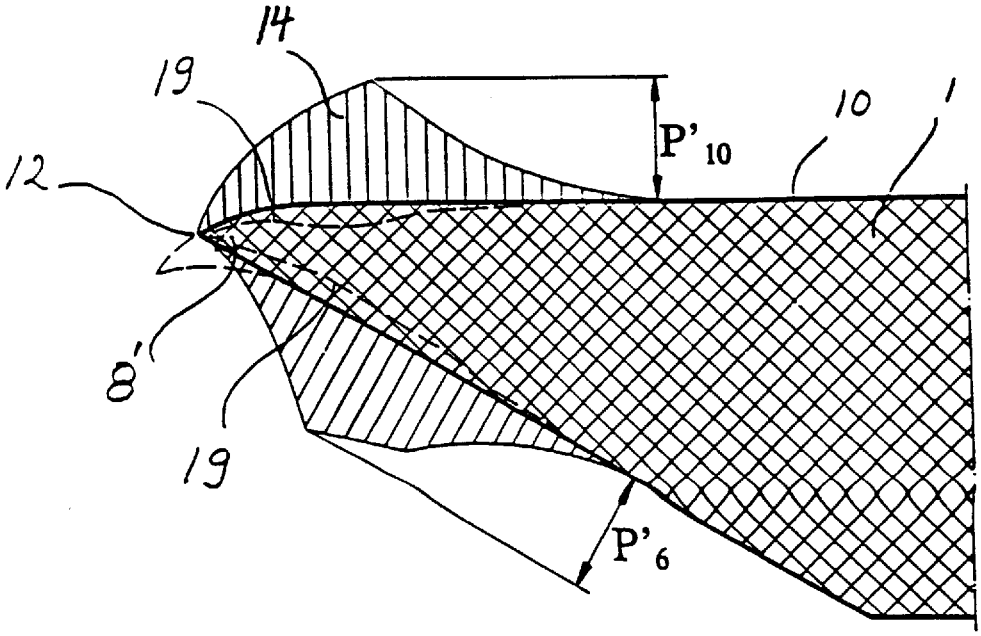

When after-grinding of the point 8 is performed on the blade 1, the compression stress levels will fall as shown in FIG. 9, especially close to the blade edge 12. Also the surface's 6 highest compression stress $P'_6 \leqq P_6$, and the surface's 10 highest compression stress $P'_{10 \leqq P10}$. This partial release of the compression stress is advantageous because there is hereby more loading tolerance in view of the yield limit of the material.

Figure 10:
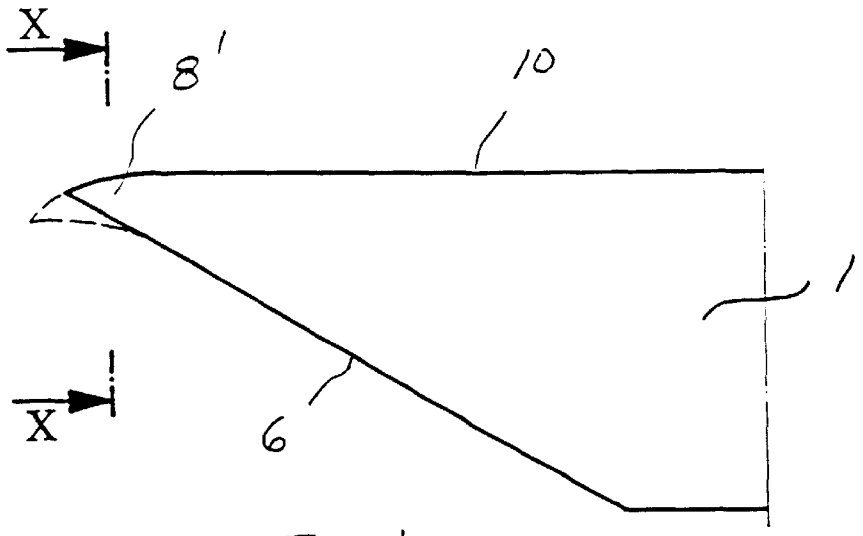
FIGS. 10 and 11 show shapes of a finished blade in accordance with the invention.
Figure 11:
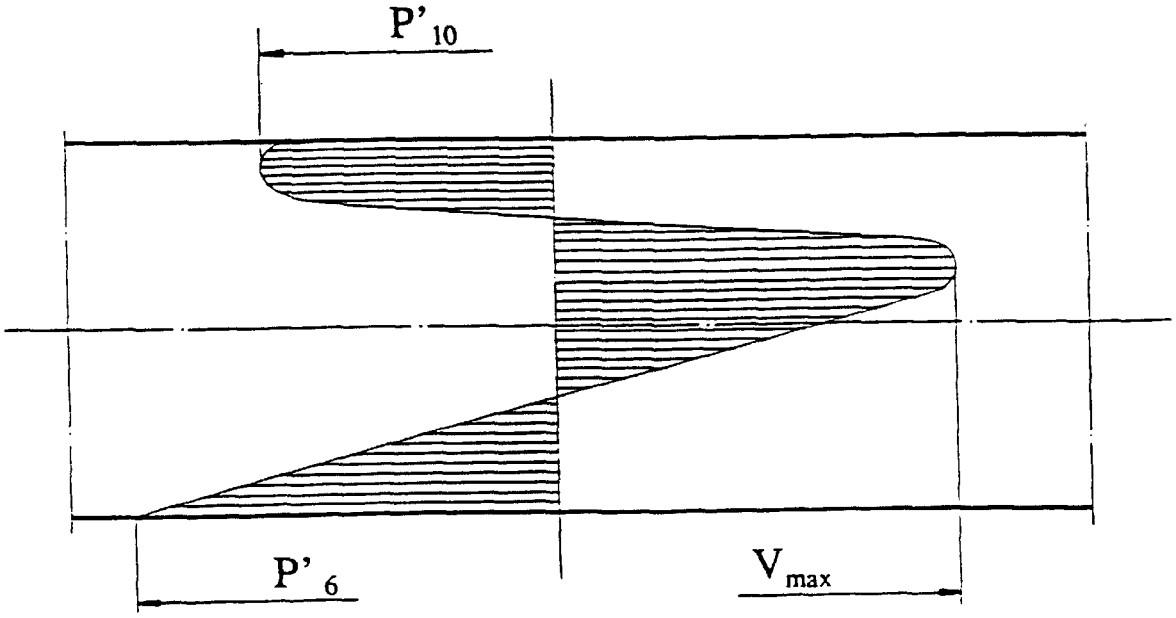

FIG. 10 shows the end of a blade 1 according to the invention, the point 8' of which is made in accordance with the present invention. FIG. 11 shows the compression stress level in a section of the point 8'. The surface 10 has a compression stress $P'_{10}$ which is almost constant 0.2–0.4 mm below the surface. The surface 6 has a compression stress $P'_6$ which below the surface falls linearly, and close to the centre of the cross-section achieves tensile stress $V_{max}$. In FIGS. 8 and 9, a dashed line 19 shows the compression-tensile stress limit below the surface.

Figure 12:
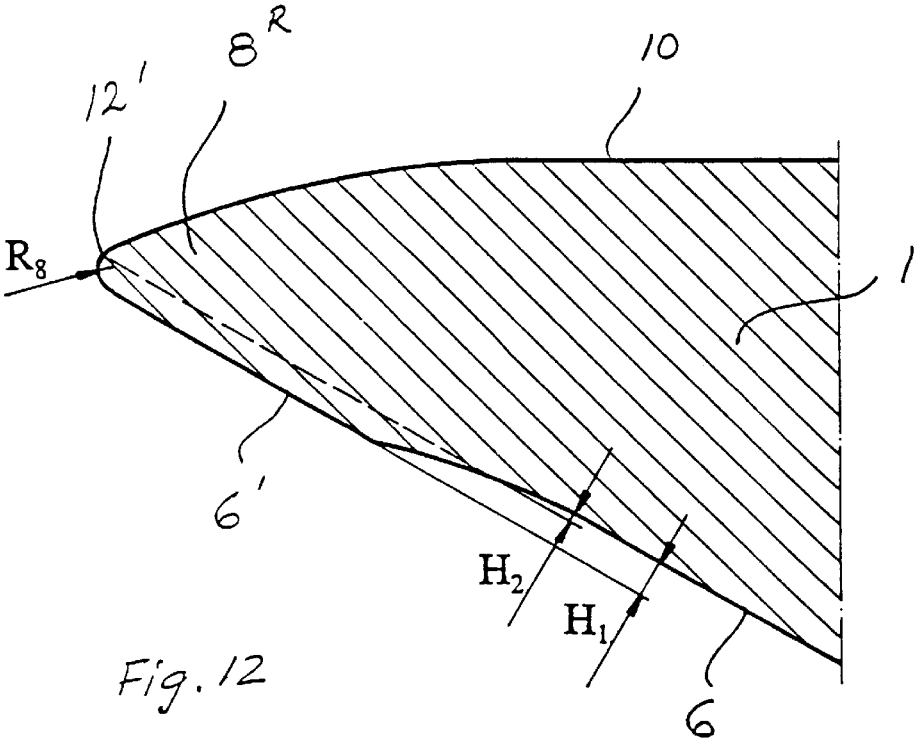
FIGS. 12 and 13 show an after-grinding method.

FIG. 12 shows the blade point 8 in accordance with the invention after use, whereby the edge 12 has vanished and been replaced by a rounded point $8^R$ with a rounding radius $R_8$. According to FIG. 2, tree fibres slide over this point long before being cut off and they wear down the point more and more. This development can be interrupted by doing a second after-grinding of the point 8 of the blade 1, whereby the measure $H_1$ is reduced or the blade surface 6 is levelled out completely. After-grinding is possible due to the "beak"-like shape of the point 8 of the blade 1, and the said after-grinding comprises removal of 0.05–0.1 mm of material along a band 0.2–0.5 mm wide. The said work can be done without removing the blades from the chipper, and hereby the exchange interval for blades 1 can be almost doubled.

FIG. 13 shows how the blade 1 is subjected to after-grinding while it is mounted to a blade disk 15. Using a manually controlled grinder 18, a very small quantity of material is hereby removed from the blade point and a sharp cutting edge 12 is obtained for the blade. After-grinding is possible only with a blade according to the invention, because the after-grinding surface 6' protruding from the sharpening surface 6 is very narrow. Everybody in the blade field knows that in practice it is too difficult to grind the whole sharpening surface 6 while the blade 1 is mounted to the blade disk 15.

The most usual way of making blades is by annealing and tempering blades 1 and by grinding the sharpening surface.

However, grinding is a slow and expensive working method and forms a great part of blade manufacturing costs. By using the method in accordance with the invention, grinding of the sharpening surface 6 before cold working can be eliminated when making a new blade, because adequate quality of the surface 6 is achieved by milling before annealing. After-grinding is hereby performed only after annealing and shot-peening. The whole sharpening surface 6 of the blade 1 is thus ground only after use, so that the pre-grinding stage can be entirely eliminated for disposable blades.

Methods in accordance with the invention can be applied not only to chippers but also when such a point 8 of a blade 1 is needed which withstands varying loads and when a very big clearance angle (suction angle β) immediately after the cutting edge 12 is useful when using the blade.

The method is also applicable for increasing durability, when the blade is one whose cutting edge has an angle of 90°.

Tests show that in connection with shot-peening the hardness of the peened surface increases by 1–2 HRC units with presently used blade materials and considerably more with other materials which will harden considerably in cold working. A better wear resistance is hereby obtained also for the blade point.

Shot-peening may also be replaced by some other cold working method creating a compression stress zone in the surface of the material. Such a method is, for example, rolling the surface with rollers and using a high surface pressure.

The principal field of application of the invention is wood chipper blades where by using the invention, blade durability and chip equality can be improved considerably. In addition, the invention brings savings in blade costs, blade exchange time, chipper auxiliary equipment (screens, chip cutters) and wood consumption.

In the above description and in the following claims the term blade point means the part in the longitudinal direction of the blade, located on both sides of the cutting edge. In the applications shown in the Figures, it is formed by the actual sharpening surface 6 and by the surface 10 detaching chips.

We claim:

1. A method of increasing durability of a cutting point part of a blade used for chipping wood so that a compression stress is formed in a blade surface for detaching chips comprising the steps of:

cold working the blade surface for detaching chips such that a compression stress is formed in the blade surface for detaching chips and such that a point part of the blade between the blade surface for detaching chips and a sharpening surface bends towards the sharpening surface and a compression stress resulting from bending the point part occurs in the sharpening surface; and performing an after-grinding operation on the point part after the point part is bent toward the sharpening surface so that an after-grinding surface protrudes from a plane of the sharpening surface.

2. A method as defined in claim 1, wherein the point part is bent through cold working so that an edge angle between the blade surface for detaching chips and the sharpening surface of 40–60° results.

3. A method as defined in claim 1, comprising the further step of performing a second after-grinding operation on a surface protruding from the sharpening surface after bending of the point part so that a plane of the surface at least approaches the plane of the sharpening surface.

4. A method as defined in claim 3, wherein the after-grinding operation is performed while the blade is in place in a device in which it is used.

5. A method as defined in claim 1, comprising the further steps of annealing the blade, and machining the sharpening surface the blade before annealing, and wherein the after-grinding operation on the point is done on the after-grinding surface only after the cold working step.

6. A method as defined in claim 2, comprising the further step of performing a second after-grinding operation on a surface protruding from the sharpening surface after bending of the point part so that a plane of the surface at least approaches the plane of the sharpening surface.

7. A method as defined in claim 2, wherein the after-grinding operation is performed while the blade is in place in a device in which it is used.

8. A method as defined in claim 3, wherein the after-grinding operation is performed while the blade is in place in a device in which it is used.

9. A cutting blade comprising:

a surface for detaching chips having a compression stress, therein, the compression stress being formed by cold working;

a sharpening surface; and a blade point part between the surface for detaching chips and the sharpening surface, wherein the point part is bent towards the sharpening surface and compression stress results in the sharpening surface by cold working the surface for detaching chips, wherein a bent part of the point part is subjected to after-grinding to form an after-grinding surface protruding beyond a plane of the sharpening surface.

10. A blade as defined in claim 9, wherein an angle between the surface for detaching chips and a surface of the bent part of the point part is larger than an angle between the surface for detaching chips and the sharpening surface.

11. A blade as defined in claim 7, wherein a tip of the bent part of the point part is raised a distance from the sharpening surface.

12. A blade as defined in claim 9, wherein a tip of the bent part of the point part is raised a distance from the sharpening surface.

* * * * *